US010018111B2

(12) United States Patent
Mizutani et al.

(10) Patent No.: US 10,018,111 B2
(45) Date of Patent: Jul. 10, 2018

(54) OUTBOARD MOTOR

(71) Applicant: YAMAHA HATSUDOKI KABUSHIKI KAISHA, Iwata-shi, Shizuoka (JP)

(72) Inventors: Makoto Mizutani, Shizuoka (JP); Tomohiro Hagi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/649,889

(22) Filed: Jul. 14, 2017

(65) Prior Publication Data

US 2017/0314461 A1 Nov. 2, 2017

(30) Foreign Application Priority Data

May 17, 2017 (JP) ..... 2017-098406

(51) Int. Cl.

| | |
|---|---|
| ***B63H 1/15*** | (2006.01) |
| ***B63H 21/30*** | (2006.01) |
| ***F02B 61/04*** | (2006.01) |
| ***B63H 20/12*** | (2006.01) |
| *F02M 35/16* | (2006.01) |

(52) U.S. Cl.

CPC ..... *F02B 61/045* (2013.01); *B63H 20/12* (2013.01); *B63H 21/305* (2013.01); *F02M 35/165* (2013.01)

(58) Field of Classification Search

CPC ..... B63H 20/00; B63H 20/02; B63H 20/12; B63H 21/30; B63H 21/302; B63H 21/305; B63H 2020/00; B63H 2020/02; B63H 2020/08; B63H 2021/30; F02B 61/045; F02M 35/165

USPC ..... 440/52, 53, 61 S

See application file for complete search history.

(56) References Cited

U.S. PATENT DOCUMENTS

| | | | | |
|---|---|---|---|---|
| 3,961,595 | A * | 6/1976 | Meyer | B63H 21/305 440/52 |
| 5,306,184 | A * | 4/1994 | Nakayama | B63H 20/26 181/235 |
| 5,309,877 | A * | 5/1994 | Shigedomi | F02B 61/045 123/192.2 |
| 5,503,576 | A * | 4/1996 | Ming | B63H 21/305 440/52 |
| 6,645,019 | B1 | 11/2003 | Shiomi et al. | |
| 7,896,304 | B1 | 3/2011 | Eichinger et al. | |
| 9,376,191 | B1 * | 6/2016 | Jaszewski | B63H 20/02 |

(Continued)

FOREIGN PATENT DOCUMENTS

JP 2001-088787 A 4/2001

*Primary Examiner* — Daniel V Venne

(74) *Attorney, Agent, or Firm* — Keating and Bennett, LLP

(57) ABSTRACT

An outboard motor includes an outboard motor main body including an engine and a propeller driven by the engine, an upper bracket to attach the outboard motor main body to a hull, and a pair of antivibration mounts. The pair of antivibration mounts are joined to the upper bracket, and sandwich and elastically support a portion of the outboard motor main body from the left and the right of the outboard motor main body. The pair of antivibration mounts are arranged side by side in the left-right direction so that a center of rolling of the outboard motor main body is located between the pair of antivibration mounts in the left-right direction, and are bilaterally asymmetrical to each other.

11 Claims, 10 Drawing Sheets

(56) References Cited

U.S. PATENT DOCUMENTS

| | | | | |
|---|---|---|---|---|
| 9,643,703 | B1 * | 5/2017 | Eichinger | B63H 20/02 |
| 9,701,383 | B1 * | 7/2017 | Stuber | B63H 20/06 |

* cited by examiner

OUTBOARD MOTOR

CROSS REFERENCE TO RELATED APPLICATIONS

This application claims the benefit of priority to Japanese Patent Application No. 2017-98406 filed on May 17, 2017. The entire contents of this application are hereby incorporated herein by reference.

BACKGROUND OF THE INVENTION

1. Field of the Invention

The present invention relates to an outboard motor.

2. Description of the Related Art

An outboard motor main body of an outboard motor described in the specification of U.S. Pat. No. 7,896,304 is attached to a hull via a transom bracket and a steering bracket. The transom bracket supports the steering bracket turnably around a vertically extending steering axis. The steering bracket supports a pair of mounts. These mounts are configured bilaterally symmetrically about the steering axis. Each mount includes a rod to be fitted to the steering bracket, a tube to be fitted to the outboard motor main body while surrounding the rod, and an elastomer disposed between the rod and the tube. Due to elastic deformation of the elastomer, transmission of vibration of the outboard motor main body to the hull is suppressed.

An outboard motor main body of an outboard motor described in Japanese Patent Application Publication No. 2001-88787 is attached to a hull via an attaching bracket. To an attaching bracket main body, a front end of a swing arm is joined via a fulcrum pin. A rear end of the swing arm is coupled to a swivel case. A vertically extending swivel shaft is fitted to the inside of the swivel case. At an upper end of the swivel shaft, a mount arm is provided. To the mount arm, a pair of upper mounts to be elastically connected to the outboard motor main body are attached. These upper mounts are configured bilaterally symmetrically about the swivel shaft. Each upper mount includes a core metal fixed to the mount arm and an upper mount rubber covering the core metal. Due to elastic deformation of the upper mount rubber, transmission of vibration of the outboard motor main body to the hull is suppressed.

As described in U.S. Pat. No. 7,896,304 and Japanese Patent Application Publication No. 2001-88787, in the structure in which the outboard motor main body is elastically supported by a pair of left and right elastic members, when both elastic members equally elastically deform to attenuate vibration of the outboard motor main body, the outboard motor main body greatly rolls. This deteriorates the appearance of the outboard motor main body during traveling. In a case where a plurality of outboard motor main bodies are present, a sufficient space must be maintained between the outboard motor main bodies adjacent to each other to prevent them from coming into contact with each other due to rolling.

SUMMARY OF THE INVENTION

In order to overcome the previously unrecognized and unsolved challenges described above, a preferred embodiment of the present invention provides an outboard motor including an outboard motor main body that includes an engine and a propeller driven by the engine, a bracket to attach the outboard motor main body to a hull, and a pair of antivibration mounts. The pair of antivibration mounts are joined to the bracket and sandwich and elastically support a portion of the outboard motor main body from the left and the right of the outboard motor main body. The pair of antivibration mounts are arranged side by side in the left-right direction so that a center of rolling of the outboard motor main body is located between the pair of antivibration mounts in the left-right direction, and are bilaterally asymmetrical to each other.

According to this preferred embodiment, due to respective elastic deformation of the pair of antivibration mounts, vibration of the outboard motor main body is attenuated, so that transmission of the vibration of the outboard motor main body to the hull is reduced. The pair of antivibration mounts are bilaterally asymmetrical to each other so that the manner in which the application of a force to the antivibration mounts from the outboard motor main body when rolling caused by vibration differs from each other between the pair of antivibration mounts. That is, the manner of receiving a force by the antivibration mounts differs from each other between the pair of antivibration mounts. Accordingly, the antivibration mounts do not elastically deform in the same way, so that an elastic deformation amount in at least one antivibration mount is reduced. Therefore, rolling of the outboard motor main body is reduced.

In a preferred embodiment of the present invention, each of the pair of antivibration mounts preferably includes a shaft extending rearward from the bracket, and an elastic portion that has a cylindrical or substantially cylindrical shape (hereafter "cylindrical shape") surrounding the shaft and joined to the outboard motor main body.

In this case, in at least one of the antivibration mounts, an axial direction of the shaft and a tangential direction with respect to a circumferential direction around a center of rolling at a location in the elastic portion to which a force from the outboard motor main body is applied when the rolling occurs cross each other in a planar view.

According to this preferred embodiment, in each antivibration mount, due to elastic deformation of the elastic portion surrounding the shaft, vibration of the outboard motor main body is attenuated. The elastic portion preferably has a cylindrical shape surrounding the shaft, so that a rigidity of the elastic portion in a perpendicular direction perpendicular to the axial direction of the shaft is higher than a rigidity of the elastic portion in the axial direction.

In both antivibration mounts, it is assumed that the axial direction of the shaft and the tangential direction with respect to a circumferential direction around a center of rolling at a location in the elastic portion to which a force from the outboard motor main body is applied when the rolling occurs, are parallel to each other in a planar view. In this case, the force from the outboard motor main body when rolling occurs is applied to the elastic portion along the axial direction, so that the elastic portion largely deforms in the axial direction to attenuate vibration of the outboard motor main body. When the elastic portions of both antivibration mounts thus largely deform, the outboard motor main body greatly rolls.

However, according to the present preferred embodiment, in at least one of the antivibration mounts, the axial direction of the shaft and the tangential direction cross each other in a planar view. Therefore, in at least this one of the antivibration mounts, the force from the outboard motor main body when rolling occurs is not biased only in the axial direction but is distributed in both of the axial direction and the perpendicular direction and applied to the elastic portion, so that an elastic deformation amount of the elastic portion is reduced. Accordingly, rolling of the outboard motor main body is reduced.

In a preferred embodiment of the present invention, a location in the elastic portion to which a force from the outboard motor main body is applied when rolling occurs preferably differs between the pair of antivibration mounts in the front-rear direction.

According to this preferred embodiment, in at least one of the antivibration mounts, the axial direction of the shaft and the tangential direction cross each other in a planar view. Accordingly, by reducing an elastic deformation amount of the elastic portion of at least one of the antivibration mounts, rolling of the outboard motor main body is reduced.

In a preferred embodiment of the present invention, a location of the elastic portion in the front-rear direction preferably differs between the pair of antivibration mounts.

According to this preferred embodiment, in at least one of the antivibration mounts, the axial direction of the shaft and the tangential direction cross each other in a planar view. Accordingly, by reducing an elastic deformation amount of the elastic portion of at least one of the antivibration mounts, rolling of the outboard motor main body is reduced.

In a preferred embodiment of the present invention, in the elastic portion, a cut-away portion is preferably provided in a portion extending in a circumferential direction around the shaft, and a location of the cut-away portion in the front-rear direction preferably differs between the pair of antivibration mounts.

According to this preferred embodiment, the pair of antivibration mounts are bilaterally asymmetrical to each other and, therefore, by reducing an elastic deformation amount of the elastic portion of at least one of the antivibration mounts, rolling of the outboard motor main body is reduced.

In a preferred embodiment of the present invention, a rigidity of a portion of the elastic portion to which a force from the outboard motor main body is applied when rolling occurs preferably differs between the pair of antivibration mounts.

According to this preferred embodiment, the pair of antivibration mounts are bilaterally asymmetrical to each other and, therefore, by reducing an elastic deformation amount of the elastic portion of at least one of the antivibration mounts, rolling of the outboard motor main body is reduced.

In a preferred embodiment of the present invention, an insertion hole extending in the axial direction of the shaft is preferably provided in the elastic portion, and each of the pair of antivibration mounts preferably further includes an insertion member to be inserted into the insertion hole. In this case, a position of the insertion member in the insertion hole differs between the pair of antivibration mounts.

According to this preferred embodiment, the pair of antivibration mounts are bilaterally asymmetrical to each other and, therefore, by reducing an elastic deformation amount of the elastic portion of at least one of the antivibration mounts, rolling of the outboard motor main body is reduced.

In a preferred embodiment of the present invention, the pair of antivibration mounts includes a first antivibration mount positioned upstream in a direction in which a reaction force generated by rotation of the propeller is applied, a location to which a force from the outboard motor main body is applied when rolling occurs is preferably spaced farther apart from the center of rolling than a location in a second antivibration mount to which a force from the outboard motor main body is applied when rolling occurs.

According to this preferred embodiment, when an influence of a reaction force generated by rotation of the propeller is a significant cause of rolling of the outboard motor main body, a proportion of this reaction force as a force to be applied from the outboard motor main body to the antivibration mount when rolling occurs is high. In this case, the first antivibration mount positioned upstream in an application direction of this reaction force receives a force from the outboard motor main body at a location distant from a center of the rolling. Accordingly, according to "the principle of leverage" using the center of rolling as a fulcrum, this first antivibration mount is less influenced by the reaction force. Therefore, due to a small elastic deformation amount of this first antivibration mount, the force from the outboard motor main body is absorbed and vibration of the outboard motor main body is attenuated. Therefore, since the elastic deformation amount in this first antivibration mount is reduced, rolling of the outboard motor main body is reduced.

In a preferred embodiment of the present invention, a plurality of pairs of antivibration mounts are preferably provided, and the plurality of pairs of antivibration mounts are preferably spaced apart in the up-down direction.

According to this preferred embodiment, in each pair of antivibration mounts, an elastic deformation amount in at least one of the pair of antivibration mounts is reduced, therefore, rolling of the outboard motor main body is further reduced.

In a preferred embodiment of the present invention, at least a portion of the antivibration mount is preferably disposed directly below the engine.

According to this preferred embodiment, the antivibration mount does not need to be long enough to be disposed outside the engine in a planar view. When the antivibration mount is long, to secure its strength, a support member such as a bracket to support the antivibration mount needs to be increased in size. However, in the case of the antivibration mount of this preferred embodiment, a strength to support the outboard motor main body is secured without increasing the size of the support member. In addition, at least a portion of the antivibration mount is disposed directly below the engine, so that a width of the outboard motor main body in the left-right direction around the engine is small.

As described above, according to preferred embodiments of the present invention, rolling of the outboard motor that is elastically supported is reduced.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
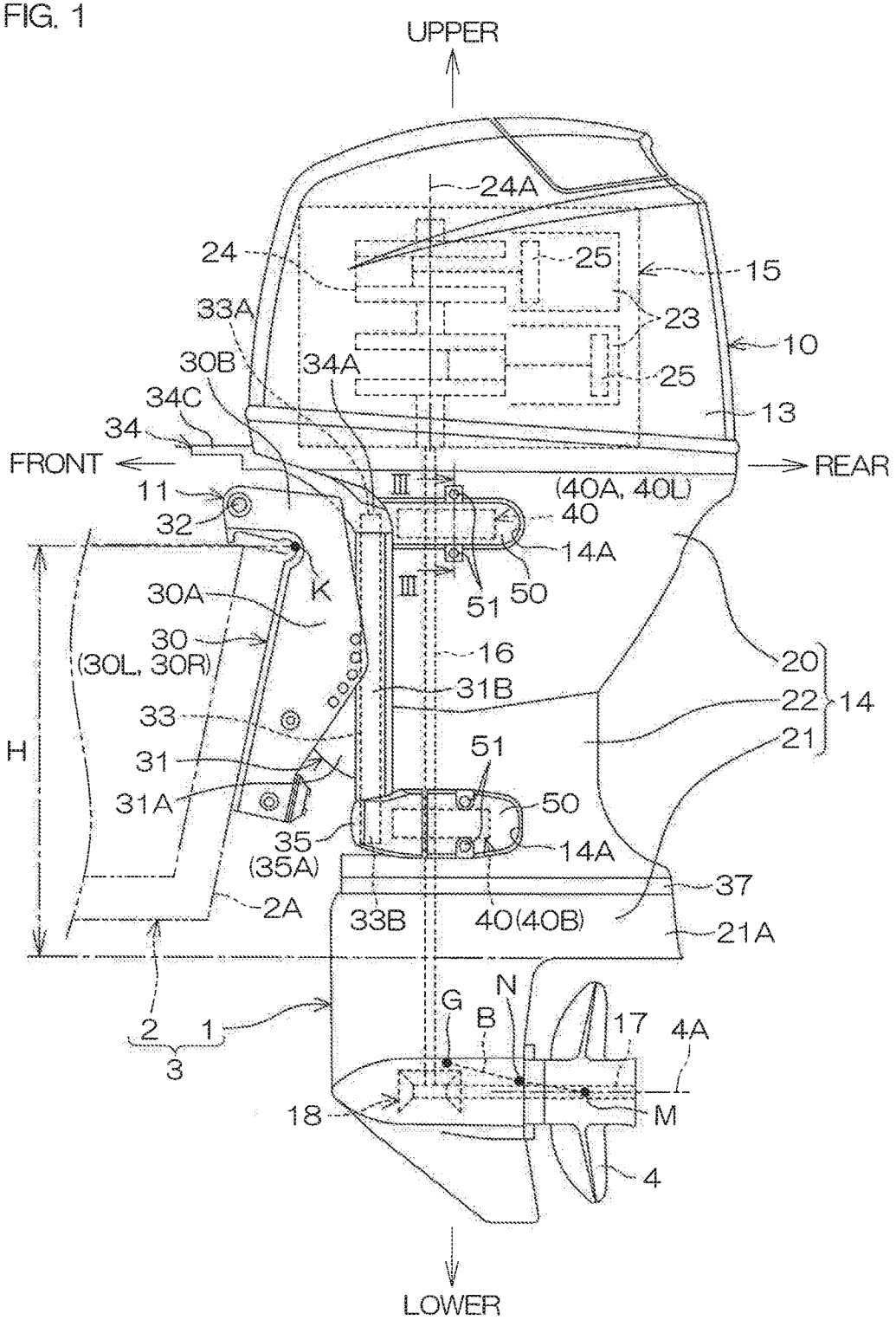
FIG. 1 is a schematic left side view of an outboard motor according to a preferred embodiment of the present invention.

Hereinafter, preferred embodiments of the present invention are described in detail with reference to the accompanying drawings. FIG. 1 is a schematic left side view of an outboard motor 1 according to a preferred embodiment of the present invention. The outboard motor 1 and a hull 2 to which the outboard motor 1 is attached define a vessel 3. FIG. 1 shows the outboard motor 1 in a reference posture. The reference posture is a posture of the outboard motor 1 in which a rotation axis 4A of a propeller 4 in the outboard motor 1 is along the horizontal direction and along a front-rear direction of the hull 2. The front-rear direction, the left-right direction, and the up-down direction in the following description correspond to the front-rear direction, the left-right direction, and the up-down direction when the outboard motor 1 is in the reference posture.

The outboard motor 1 includes an outboard motor main body 10 and an attaching mechanism 11. The outboard motor main body 10 is attached to a stern 2A of the hull 2 by the attaching mechanism 11. The outboard motor main body 10 includes the propeller 4 mentioned above, an engine cover 13, a casing 14, an engine 15, a drive shaft 16, a propeller shaft 17, and a gear mechanism 18.

The engine cover 13 preferably has the shape of a box. The casing 14 is a hollow body extending downward from the engine cover 13. An upper end of the casing 14 is referred to as a mount plate 20, a lower end of the casing 14 is referred to as a lower case 21, and a portion of the casing 14 between the mount plate 20 and the lower case 21 in the casing 14 is referred to as an upper case 22. At an upper end of the lower case 21, a cavitation plate 21A projecting rearward is provided.

The engine 15 is housed inside the engine cover 13, and mounted on the mount plate 20. The engine 15 is, for example an internal combustion engine that generates power by burning a fuel such as gasoline, and includes a combustion chamber 23, a crankshaft 24, and a piston 25. The crankshaft 24 has a crank axis 24A extending in the up-down direction. By burning an air-fuel mixture inside the combustion chamber 23, the piston 25 linearly reciprocates in the front-rear direction perpendicular to the crank axis 24A. Accordingly, the crankshaft 24 is driven to rotate around the crank axis 24A.

The drive shaft 16 extends in the up-down direction inside the casing 14. An upper end of the drive shaft 16 is joined to a lower end of the crankshaft 24. A lower end of the drive shaft 16 is disposed inside the lower case 21. When the crankshaft 24 is driven to rotate, the drive shaft 16 rotates integrally with the crankshaft 24.

The propeller shaft 17 is disposed inside the lower case 21, and disposed along the front-rear direction at a side lower than the lower end of the drive shaft 16. The gear mechanism 18 joins the lower end of the drive shaft 16 and the front end of the propeller shaft 17. To a rear end of the propeller shaft 17, the propeller 4 is attached. The propeller 4 is located outside the lower case 21, and disposed directly below the cavitation plate 21A. Rotation of the drive shaft 16 due to driving of the engine 15 is transmitted to the propeller shaft 17 by the gear mechanism 18. Accordingly, the propeller 4 is driven to rotate by the engine 15. The rotation axis 4A of the propeller 4 corresponds to a central axis of the propeller shaft 17. Due to rotation of the propeller 4, a propulsive force to propel the hull 2 forward or backward is generated.

The attaching mechanism 11 includes an attaching bracket 30, a swivel bracket 31, a tilt shaft 32, a steering shaft 33, an upper bracket 34, and a lower bracket 35.

The attaching bracket 30 includes a left bracket 30L and a right bracket 30R disposed at an interval in the left-right direction. Each of the left bracket 30L and the right bracket 30R integrally includes a vertical portion 30A facing a rear surface of the stern 2A of the hull 2 from the rear side, and a horizontal portion 30B extending forward from an upper end of the vertical portion 30A and facing an upper end of the stern 2A from the upper side. Each of the left bracket 30L and the right bracket 30R is fixed to the stern 2A by a fastener 36 such as a bolt, for example (refer to FIG. 4A described below). A height dimension H between an intersection K of a front surface of the vertical portion 30A and a lower surface of the horizontal portion 30B, and a lower surface of the cavitation plate 21A, may be referred to as a "transom height" or "shaft length." The height dimension H differs depending on performance, etc., required for the outboard motor 1. By interposing an extension 37 between the lower case 21 and the upper case 22, the height dimension H may be increased. By changing the size of the upper case 22, the height dimension H may be changed without using the extension 37.

The swivel bracket 31 integrally includes an interposed portion 31A and a cylinder portion 31B provided at a rear end of the interposed portion 31A. The interposed portion 31A is disposed between the left bracket 30L and the right bracket 30R. The cylinder portion 31B preferably has a cylindrical or substantially cylindrical shape extending in the up-down direction. A tilt shaft 32 extends in the left-right direction and joins the interposed portion 31A to the left bracket 30L and the right bracket 30R. Accordingly, the swivel bracket 31 is enabled to turn up and down around the tilt shaft 32 with respect to the attaching bracket 30.

The steering shaft 33 extends in the up-down direction and is inserted into the cylinder portion 31B. The steering shaft 33 is rotatable around a central axis of the steering shaft 33 with respect to the cylinder portion 31B. An upper end 33A of the steering shaft 33 projects upward from an upper end of the cylinder portion 31B, and a lower end 33B of the steering shaft 33 projects downward from a lower end of the cylinder portion 31B.

The upper bracket 34 and the lower bracket 35 are examples of brackets that attach the outboard motor main body 10 to the hull 2. The upper bracket 34 is fixed to the upper end 33A of the steering shaft 33. The lower bracket 35 is located lower than the upper bracket 34 and fixed to the lower end 33B of the steering shaft 33. The outboard motor 1 includes pairs of antivibration mounts 40, each pair of which are provided for each of the upper bracket 34 and the lower bracket 35 and elastically support the outboard motor main body 10. The upper bracket 34 is joined to the mount plate 20 of the outboard motor main body 10 via one pair of antivibration mounts 40. The lower bracket 35 is joined to a lower portion of the upper case 22 of the outboard motor main body 10 via the other pair of antivibration mounts 40.

The outboard motor main body 10 and the swivel bracket 31 are able to turn up and down around the tilt shaft 32 with respect to the attaching bracket 30. By turning the outboard motor main body 10 around the tilt shaft 32, the outboard motor main body 10 is inclined with respect to the hull 2 and the attaching bracket 30. The outboard motor main body 10 is turnable in the left-right direction together with the steering shaft 33 with respect to the attaching bracket 30 and the swivel bracket 31.

A plurality of kinds of outboard motors 1 may be present according to differences in the structure of the lower case 21 and the propeller 4, etc., although the engine 15 is common. For example, in the case of an outboard motor 1 for a high-speed boat, at a front end portion of the lower case 21, a projection projecting forward is provided to reduce water resistance. In the case of an outboard motor 1 for high loads, a large-diameter propeller 4 is used. When acceleration of the vessel 3 is important, two propellers 4 that rotate reversely to each other are disposed coaxially.

Figure 2:
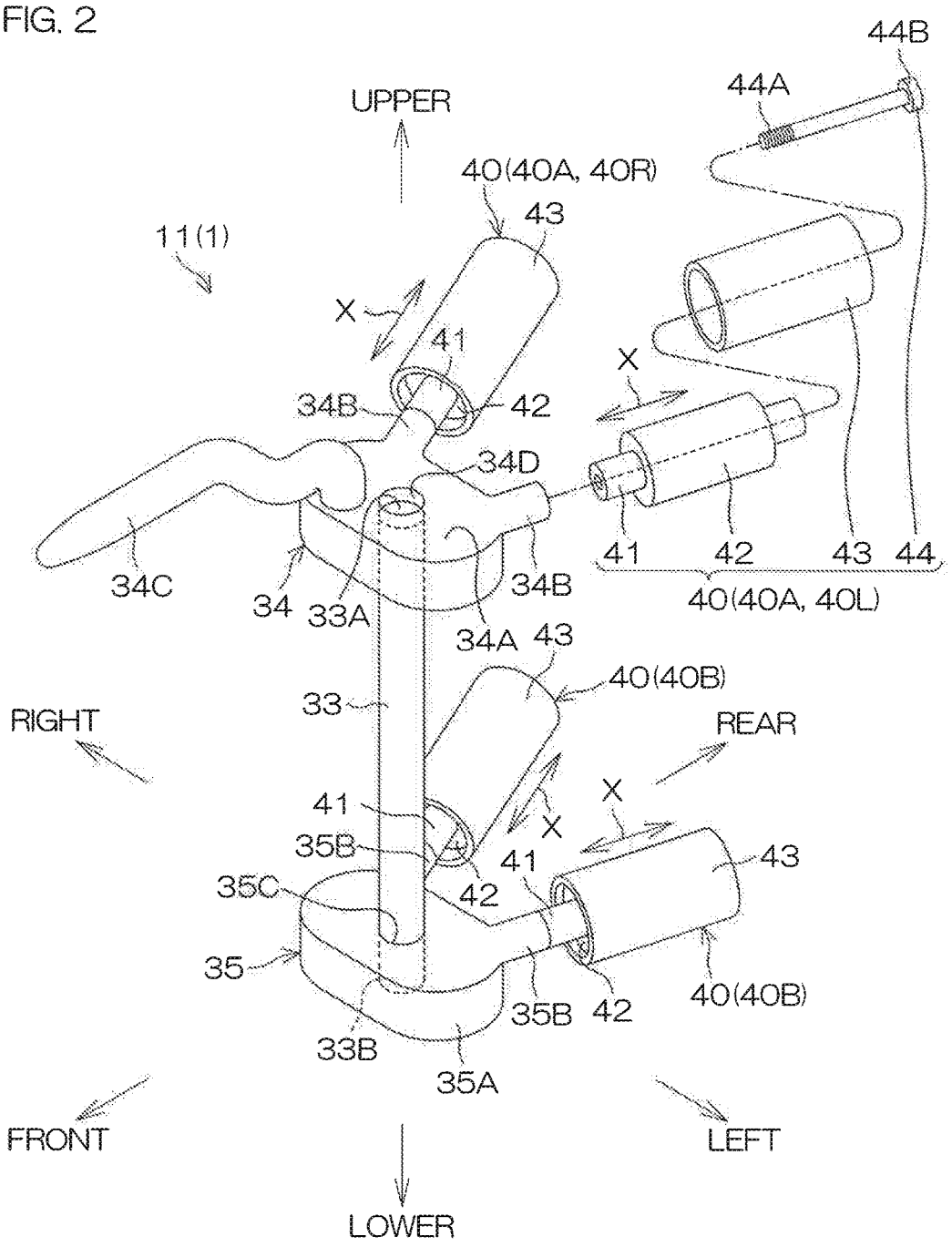
FIG. 2 is a schematic perspective view showing a structure in an outboard motor to attach an outboard motor main body to a hull.

Next, the upper bracket 34, the lower bracket 35, and the antivibration mounts 40 are described in detail. FIG. 2 is a schematic perspective view showing the steering shaft 33, the upper bracket 34, the lower bracket 35, and the antivibration mounts 40 being a portion of a structure that attach the outboard motor main body 10 to the hull 2. In FIG. 2, an exploded perspective view of one antivibration mount 40 is shown.

The upper bracket 34 integrally includes a main body 34A, a pair of projections 34B, and a lever 34C. The main body 34A preferably has the shape of, for example, a block. At a center of the main body 34A in a planar view, an insertion hole 34D is provided into which the upper end 33A of the steering shaft 33 is inserted from below. Each of the pair of projections 34B preferably has, for example, a columnar shape. The pair of projections 34B are disposed side by side in the left-right direction, and project rearward from the main body 34A. The pair of projections 34B may extend parallel to each other, or may be disposed so that a distance between them increases toward the rear side as shown in FIG. 2. The pair of projections 34B may be disposed along the horizontal direction, or may be inclined with respect to the horizontal direction. In each projection 34B, a screw hole 34E extending forward from a rear end surface of the projection 34B is provided (refer to FIG. 4A). The lever 34C extends forward from, for example, a portion farther frontward than the insertion hole 34D on an upper surface of the main body 34A. When a vessel operator holds the lever 34C and moves it to the left or right, or the lever 34C is moved to the left or right by an electric steering device (not shown), the outboard motor main body 10 turns in the left-right direction together with the steering shaft 33, so that the vessel 3 is steered.

The lower bracket 35 integrally includes a main body 35A and a pair of projections 35B. The main body portion 35A preferably has the shape of, for example, a block. At the center of the main body 35A in a planar view, an insertion hole 35C is provided into which the lower end portion 33B of the steering shaft 33 is inserted from above. Each of the pair of projections 35B preferably has, for example, a columnar shape. The pair of projections 35B are disposed side by side in the left-right direction, and project rearward from the main body 35A. The pair of projections 35B may extend parallel to each other, or may be disposed so that a distance between them increases toward the rear side as shown in FIG. 2. The pair of projections 35B may be disposed along the horizontal direction, or may be inclined with respect to the horizontal direction. In each projection 35B, a screw hole (not shown) extending forward from a rear end surface of the projection 35B is provided.

A pair of antivibration mounts 40 are provided for the pair of projections 34B in the upper bracket 34, and another pair of antivibration mounts 40 are provided for the pair of projections 35B in the lower bracket 35. That is, the outboard motor 1 includes a plurality (for example, two) of pairs of antivibration mounts 40. The two pairs of antivibration mounts 40 are spaced apart in the up-down direction according to the vertical positional relationship between the upper bracket 34 and the lower bracket 35. The pair of antivibration mounts 40 for the upper bracket 34 are referred to as a pair of upper antivibration mounts 40A, and the other pair of antivibration mounts 40 for the lower bracket 35 are referred to as a pair of lower antivibration mounts 40B. Each antivibration mount 40 includes a shaft 41, an elastic portion 42, an outer cylinder portion 43, and a fastener 44. It is noted that the outer cylinder portion 43 is fixed to the casing 14 of the outboard motor main body 10 as described below, so that the outer cylinder portion 43 may be regarded as not a portion of the antivibration mount 40 but a portion of the casing 14.

The shaft 41 preferably has a circular or substantially circular tube shape and is made of, for example, a metal such as aluminum. A front end surface of the shaft 41 in each of the pair of upper antivibration mounts 40A abuts against a rear end surface of any projection 34B of the upper bracket 34 from the rear side, and this shaft 41 is disposed coaxially with the projection 34B. The shaft 41 in each of the pair of upper antivibration mounts 40A extends rearward from the upper bracket 34. A front end surface of the shaft 41 in each of the pair of lower antivibration mounts 40B abuts against a rear end surface of any projection 35B of the lower bracket 35 from the rear side, and this shaft 41 is disposed coaxially with the projection 35B. The shaft 41 in each of the pair of lower antivibration mounts 40B extends rearward from the lower bracket 35.

The elastic portion 42 preferably has a cylindrical shape and is made of an elastic material such as rubber or sponge. In detail, the elastic portion 42 has a cylindrical shape having an inner diameter equal or substantially equal to an outer diameter of the shaft 41, and attached coaxially to the shaft 41 and surrounds the shaft 41. In terms of a dimension in the axial direction X of the shaft 41, the shaft 41 is larger than the elastic portion 42. Therefore, both end portions of the shaft 41 in the axial direction X protrude from the elastic portion 42. A front end surface and a rear end surface of the elastic portion 42 surrounding the shaft 41 may include flat surfaces perpendicular or substantially perpendicular to the axial direction X, or may include curved surfaces. A section of an outer circumferential surface of the elastic portion 42 may not be circular, and may be rectangular, for example.

The outer cylinder portion 43 has a cylindrical shape slightly larger than the elastic portion 42 and is made of, for example, a metal such as aluminum. In the present preferred embodiment, the outer cylinder portion 43 has a cylindrical shape having an inner diameter equal or substantially equal to an outer diameter of the elastic portion 42, attached coaxially to the elastic portion 42, and surrounds the elastic portion 42. In terms of a dimension in the axial direction X, the outer cylinder portion 43 is larger than the elastic portion 42. Therefore, both end portions of the outer cylinder portion 43 in the axial direction X protrude from the elastic portion 42. The outer cylinder portion 43 is not in contact with the shaft 41. The elastic portion 42 may be always compressed between the shaft 41 and the outer cylinder portion 43.

The fastener 44 is, for example, a bolt, and is inserted to the inside of the shaft 41 from the rear side. A front end of the fastener 44 includes a tip end 44A that is threaded. In each of the pair of upper antivibration mounts 40A, the tip end 44A is fitted into the screw hole 34E of the projection 34B in the upper bracket 34, and the shaft 41 is sandwiched between a head 44B at the rear end of the fastener 44 and the projection 34B (refer to FIG. 4A). Accordingly, each of the pair of upper antivibration mounts 40A is joined to any projection 34B in the upper bracket 34. In each of the pair of lower antivibration mounts 40B, the tip end 44A of the fastener 44 is fitted into the screw hole (not shown) of the projection 35B in the lower bracket 35, and the shaft 41 is sandwiched between the head 44B of the fastener 44 and the projection 35B. Accordingly, each of the pair of lower antivibration mounts 40B is joined to any projection 35B in the lower bracket 35.

The pair of upper antivibration mounts 40A are arranged side by side in the left-right direction. The pair of lower antivibration mounts 40B are arranged side by side in the left-right direction. In the pair of upper antivibration mounts 40A, their axial directions X may extend parallel to each other, or may extend so as to separate in the left-right direction toward the rear side as shown in FIG. 2. Also, in the pair of lower antivibration mounts 40B, their axial directions X may extend parallel to each other, or may extend so as to separate in the left-right direction toward the rear side as shown in FIG. 2. The axial direction X of each antivibration mount 40 may be along the horizontal direction, or may be inclined with respect to the horizontal direction.

Referring to FIG. 1, in the casing 14 of the outboard motor main body 10, accommodation portions 14 that accommodate a portion of the outer cylinder portions 43 of the respective antivibration mounts 40 are provided. An example of the accommodation portion 14A is a recessed portion recessed from the surface of the casing 14. Each of the accommodation portions 14A for the upper antivibration mounts 40A is provided in each of, for example, front regions of left and right both side surfaces of the mount plate 20. Each of the accommodation portions 14A for the lower antivibration mounts 40B is provided in each of, for example, front regions of the left and right both side surfaces of the lower end of the upper case 22.

Figure 3:
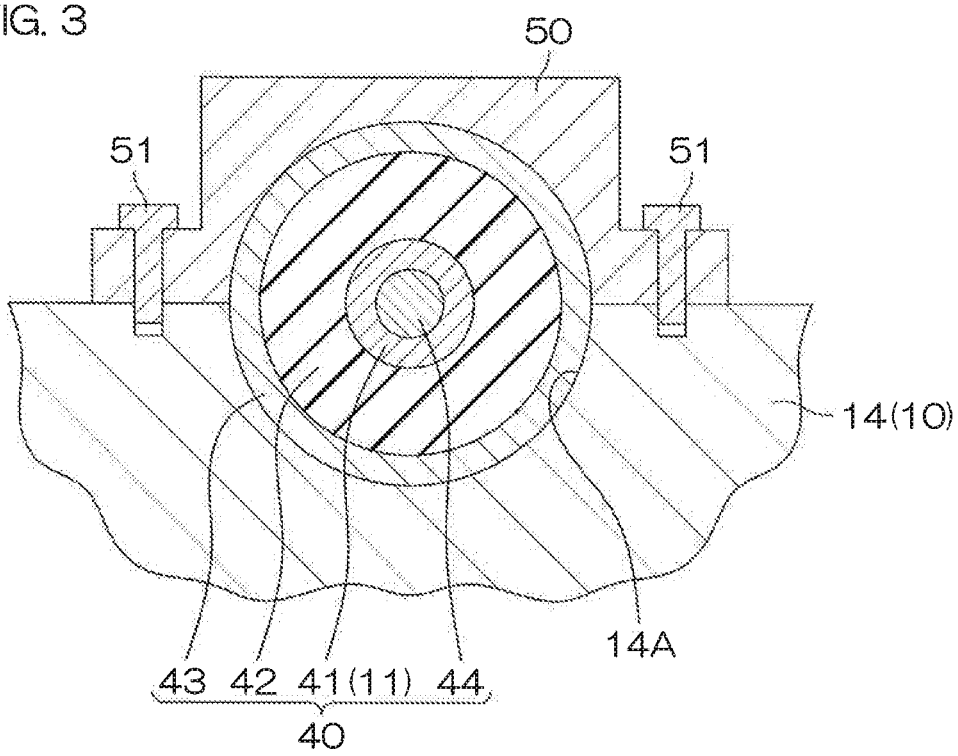
FIG. 3 is a sectional view showing a cross section taken along line III-III in FIG. 1.

FIG. 3 is a sectional view showing a cross section taken along line III-III in FIG. 1. The outboard motor main body 10 further includes fixing members 50 to fix the outer cylinder portions 43 accommodated in the accommodation portions 14A to the casing 14. The fixing member 50 preferably has the shape of, for example, a cover, and covers a portion of the outer cylinder portion 43 protruding from the accommodation portion 14A. The fixing member 50 in this state is fixed to the casing 14 by a fastener 51 such as a bolt, for example. Accordingly, the outer cylinder portion 43 is fixed to the casing 14 while being sandwiched by the fixing member 50 and the casing 14. The elastic portion 42 is joined to the casing 14, that is, the outboard motor main body 10 via the outer cylinder portion 43.

In each antivibration mount 40, the elastic portion 42 interposed between the shaft 41 on the attaching mechanism 11 side and the outer cylinder portion 43 on the outboard motor main body 10 side is elastically deformable. Therefore, the outboard motor main body 10 is elastically supported by the pair of upper antivibration mounts 40A and the pair of lower antivibration mounts 40B (refer to FIG. 1). In detail, the pair of upper antivibration mounts 40A sandwich the mount plate 20 of the outboard motor main body 10 from the left and the right of the outboard motor main body 10 and elastically support the mount plate 20 (refer to FIG. 4A). The pair of lower antivibration mounts 40B sandwich the lower end of the upper case 22 of the outboard motor main body 10 from the left and the right and elastically support this lower end. Since vibration of the outboard motor main body 10 is attenuated by elastic deformation of the elastic portion 42 in each of the pair of antivibration mounts 40 transmission of the vibration of the outboard motor main body 10 to the hull 2 is reduced.

At least a portion of each antivibration mount 40 is disposed directly below the engine 15 so as to overlap the engine 15 in a planar view (refer to FIG. 5 described below). Therefore, each antivibration mount 40 does not need to be long enough to be disposed outside the engine 15 in the left-right direction in a planar view. If each antivibration mount 40 is long, to secure its strength, the support member such as the upper bracket 34 (in particular, the projection 34B of the upper bracket 34) that supports the antivibration mount 40 needs to be made larger, and the outboard motor main body 10 is increased in width in the left-right direction. However, when using the antivibration mount 40 at least a portion of which is disposed directly below the engine 15 as in the case of the present preferred embodiment, without increasing the size of the support member, the strength to support the outboard motor main body 10 is secured. In addition, it is also possible to reduce the width of the outboard motor main body 10 in the left-right direction around the engine 15.

It is noted that the outer cylinder portions 43 of the pair of upper antivibration mounts 40A may be fixed to the casing 14 by one fixing member 50. The upper antivibration mounts 40A and the lower antivibration mounts 40B may not be structurally the same. In this case, the structure to join the antivibration mount 40 to the outboard motor main body 10 such as the accommodation portion 14A and the fixing member 50 described above may differ from each other between the upper antivibration mounts 40A and the lower antivibration mounts 40B.

Figure 4A:
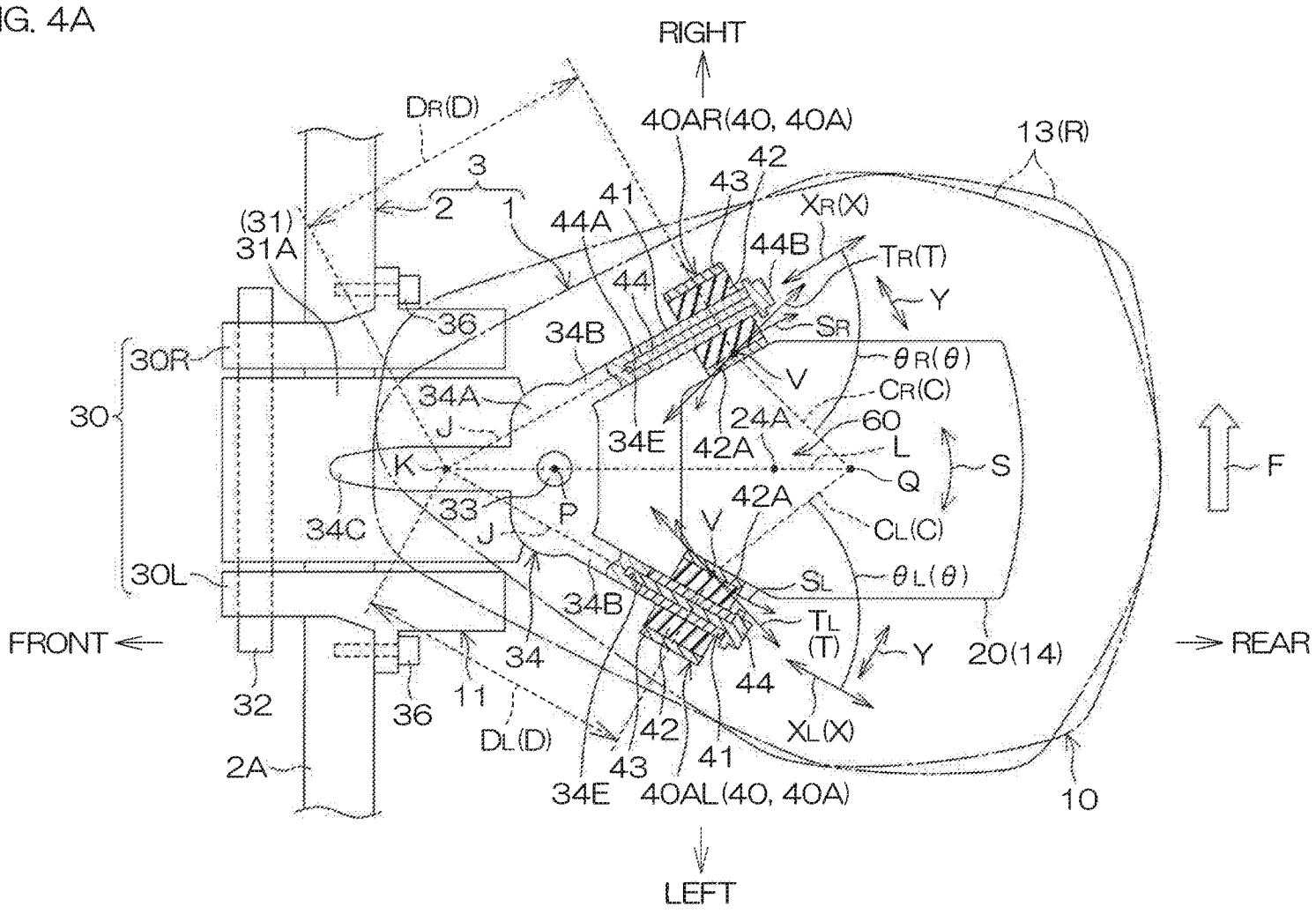
FIG. 4A is a schematic plan view of a portion of the hull and the outboard motor.

FIG. 4A is a schematic plan view of the stern 2A of the hull 2 and the outboard motor 1. In FIG. 4A, planar cross sections of a portion of the upper bracket 34 and the pair of upper antivibration mounts 40A are also shown. Hereinafter, the pair of upper antivibration mounts 40A are described, and the following structure is also applicable to the pair of lower antivibration mounts 40B.

The pair of upper antivibration mounts 40A arranged side by side in the left-right direction are disposed in a substantially V shape so as to separate in the left-right direction toward the rear side. Therefore, when the central axes J of the pair of upper antivibration mounts 40A are extended forward along their respective axial directions X, these central axes J cross each other in a planar view. When the outboard motor 1 is in the reference posture, a straight line L connecting the intersection K of these central axes J and the center P of the steering shaft 33 (turning center of the outboard motor main body 10 in a planar view) is along the front-rear direction. The straight line L is a centerline passing through the center of the outboard motor main body 10 in the left-right direction. The intersection K may be located farther frontward than the center P, may be located farther rearward than the center P, or may correspond to the center P. The crank axis 24A of the crankshaft 24 of the engine 15 is located farther rearward than the intersection K and the center P in a planar view, and disposed on the straight line L. Hereinafter, of the pair of upper antivibration mounts 40A, the left upper antivibration mount 40A is referred to as an upper antivibration mount 40AL, and the right upper antivibration mount 40A is referred to as an upper antivibration mount 40AR. Hereinafter, the axial direction X of the central axis J of the upper antivibration mount 40AL may be referred to as an axial direction $X_L$, and the axial direction X of the central axis J of the upper antivibration mount 40AR may be referred to as an axial direction $X_R$.

In FIG. 4A, a contour R of the outboard motor main body 10 in a stopped state in a planar view (a contour of the engine cover 13 in FIG. 4A) is shown by an alternate long and short dashed line. While the outboard motor 1 is activated, according to driving of the engine 15 and/or driving rotation of the propeller 4, the outboard motor main body 10 rolls. When rolling occurs, the outboard motor main body 10 reciprocates along a circumferential direction S around a predetermined center Q in a planar view. This center Q is a center of rolling of the outboard motor main body 10. Due to rolling, the contour R of the outboard motor main body 10 wiggles in the left-right direction as shown by the alternate long and short dashed line and the alternate long and two short dashed line.

The center Q is located farther rearward than the intersection K and the center P on the inner side of the contour R, and disposed on the straight line L, by way of example, in a planar view. The center Q may be disposed farther rearward than the crank axis 24A. While the outboard motor 1 is activated, the location of the center Q fluctuates within a predetermined range on the straight line L. In addition, depending on a difference in the kind of the outboard motor 1, that is, for example, a difference in the shape of the lower case 21, a difference in the structure of the propeller 4, a difference in the height dimension H, or a difference in the vertical distance between the upper antivibration mount 40A and the lower antivibration mount 40B, etc., the location of the center Q in the front-rear direction differs. Specifically, referring to FIG. 1, when the shape of the lower case 21 changes, a location of a point G of application of water pressure being a location to which a water pressure is applied in the lower case 21 when traveling forward changes. When the structure of the propeller 4 changes, a location of a point M of application of reaction force being a location to which a reaction force generated by rotation of the propeller 4 is applied in the lower case 21 changes. Thus, when the location of a point G of application of water pressure or the point M of application of reaction force changes, a location of a point N of application of a total load on the lower case 21 changes. It is noted that the point N of application is located on a line segment B connecting the point G of application of water pressure and the point M of application of reaction force. According to the change of the location of the point N of application, the location of the center Q of rolling in the front-rear direction changes. In any case, the center Q on the straight line L is located, as shown in FIG. 4A, between the pair of upper antivibration mounts 40A in the left-right direction. Specifically, the center Q is present in a region 60 sandwiched by the central axes J of the pair of upper antivibration mounts 40A in a planar view, and in particular, located at a central portion close to the straight line L in the region 60. The location of the center Q fluctuates according to a difference in the kind of the outboard motor 1 and a situation of the outboard motor 1 during activation, etc., described above, therefore, the center Q is not necessarily located on the straight line L although it is present at the central portion (near the straight line L) of the region 60.

When rolling of the outboard motor main body 10 occurs, a force from the outboard motor main body 10 is applied to the respective elastic portions 42 of the pair of upper antivibration mounts 40A via the outer cylinder portions 43. A location at which a force from the outboard motor main body 10 is applied to the elastic portion 42 when rolling occurs, is referred to as an application location V. The application location V is defined in a boundary portion between the elastic portion 42 and the outer cylinder portion 43. In the present preferred embodiment, the application location V is set, on a region 42A facing the outboard motor main body 10 on an outer circumferential surface of each elastic portion 42, to a center of the region 42A in the axial direction X, by way of example.

The pair of upper antivibration mounts 40A are bilaterally asymmetrical to each other about the straight line L and the center P of the steering shaft 33. As an example of this, in FIG. 4A, the location of the elastic portion 42 in the front-rear direction differs from each other between the pair of upper antivibration mounts 40A so that the location of the elastic portion 42 is displaced farther rearward in the upper antivibration mount 40AR than in the upper antivibration mount 40AL. Further, in FIG. 4A, the application location V in the elastic portion 42 differs from each other between the pair of upper antivibration mounts 40A in the front-rear direction so that the application location V is displaced farther rearward in the upper antivibration mount 40AR than in the upper antivibration mount 40AL. Defining the positional relationship between the elastic portions 42 of the pair of upper antivibration mounts 40A based on direct distances D extending from the intersections K to the application locations V along the axial directions X on the respective central axes J, the direction distance D differs from each other between the pair of upper antivibration mounts 40A. Regarding the direct distances D, in FIG. 4A, the direct distance DL in the upper antivibration mount 40AL is shorter than the direct distance DR in the upper antivibration mount 40AR.

Thus, in a case where the pair of upper antivibration mounts 40A are bilaterally asymmetrical to each other, the manner in which the application of a force from the outboard motor main body 10 to the upper antivibration mount 40A when rolling is caused by vibration differs from each other between the pair of upper antivibration mounts 40A. The reason for this is described below.

First, in the elastic portion 42, at the application location V, a rigidity in a perpendicular direction Y which is perpendicular to the axial direction X of the shaft 41 is higher than a rigidity in the axial direction X. This is because the shaft 41 and the cylindrical elastic portion 42 surrounding the shaft 41 are arranged side by side in the perpendicular direction Y, so that in the elastic portion 42, at the application location V, a deformation amount when a force in the perpendicular direction Y is applied is small, and a deformation amount when a force in the axial direction X is applied is large. That is, the elastic portion 42 is soft in the axial direction X, and hard in the perpendicular direction Y. Hereinafter, in both upper antivibration mounts 40A, relationships between the axial directions X of the shafts 41 and tangential directions T with respect to the circumferential directions S around the center Q of rolling of the outboard motor main body 10 at the application locations V are considered. Here, a circumferential direction S passing through the application location V of the upper antivibration mount 40AL is referred to as a circumferential direction $S_L$, and a circumferential direction S passing through the application location V of the upper antivibration mount 40AR is referred to as a circumferential direction $S_R$. A tangential direction T with respect to the circumferential direction $S_L$ is referred to as a tangential direction $T_L$, and a tangential direction T with respect to the circumferential direction $S_R$ is referred to as a tangential direction $T_R$.

Figure 4B:
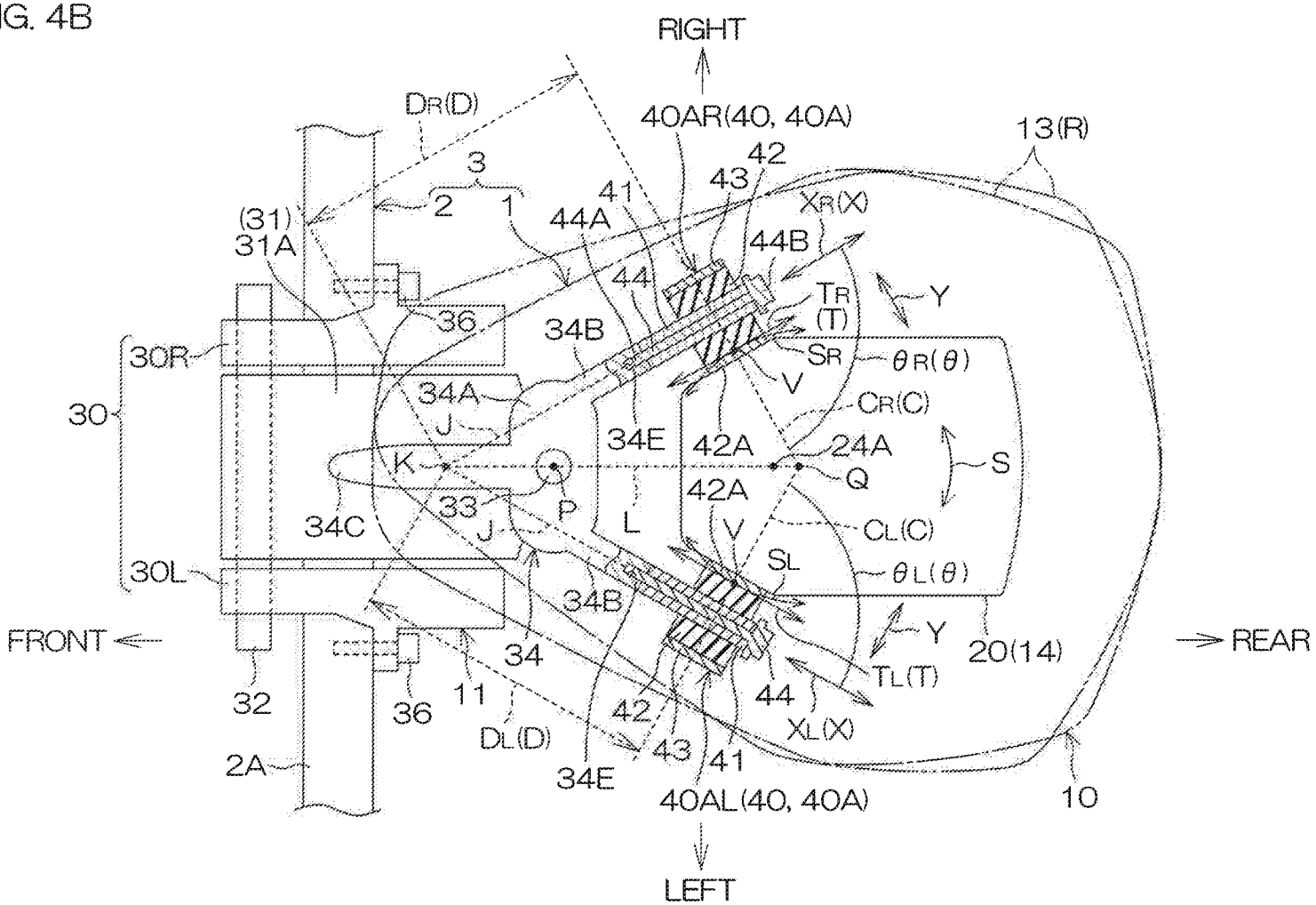
FIG. 4B is a schematic plan view of a portion of the hull and an outboard motor according to a comparative example.

A comparative example different from the present preferred embodiment is described. In the comparative example, both upper antivibration mounts 40A are bilaterally symmetrical as shown in FIG. 4B. In the case of the comparative example, a force from the outboard motor main body 10 when rolling occurs is equally applied to the upper antivibration mounts 40AL and 40AR that are bilaterally symmetrical. As described above, due to forward and rearward movement of the center Q of rolling, the axial direction X and the tangential direction T in each upper antivibration mount 40A become parallel to each other in a planar view in some cases. In the comparative example in this case, as shown in FIG. 4B, in both upper antivibration mounts 40AL and 40AR, the axial direction X and the tangential direction T simultaneously become parallel to each other. Then, a force from the outboard motor main body 10 when rolling occurs is simultaneously applied to the application locations V of the elastic portions 42 along the axial directions X in both upper antivibration mounts 40AL and 40AR. Therefore, in both antivibration mounts 40, the elastic portions 42 whose rigidities in the axial directions X are low largely deform in the axial directions X to attenuate the vibration of the outboard motor main body 10, so that the outboard motor main body 10 greatly rolls.

However, according to the present preferred embodiment shown in FIG. 4A, the pair of upper antivibration mounts 40A are bilaterally asymmetrical to each other. In addition, the axial direction X of the shaft 41 in at least one of the upper antivibration mounts 40A and the tangential direction T with respect to the circumferential direction S at the application location V of the elastic portion 42 of this upper antivibration mount 40A cross each other in a planar view. In this case, a crossing angle θ between a straight line C connecting the center Q and the application location V and the axial direction X in a planar view becomes a value different from 90 degrees. A length of the straight line $C_L$ connecting the center Q and the application location V of the upper antivibration mount 40AL and a length of the straight line $C_R$ connecting the center Q and the application location V of the upper antivibration mount 40AR are different from each other. Therefore, the circumferential direction $S_L$ and the circumferential direction $S_R$ are not located on the same circumference.

In at least one upper antivibration mount 40A positioned so that the axial direction X and the tangential direction T crosses each other in a planar view, a force from the outboard motor main body 10 when rolling occurs is not biased only in the axial direction X, but is distributed in both of the axial direction X and the perpendicular direction Y and applied to the elastic portion 42. Therefore, at least this one upper antivibration mount 40A receives a force from the outboard motor main body 10 in the perpendicular direction Y as well in which the rigidity is high, and accordingly, the elastic deformation amount of the elastic portion 42 is reduced. As in the case of FIG. 4A, at the application location V of the elastic portion 42 of each of the pair of upper antivibration mounts 40A, in a case where the axial direction X and the tangential direction T crosses each other, the above-described crossing angle θ differs from each other between the pair of upper antivibration mounts 40A. Specifically, a crossing angle $\theta_L$ between the straight line $C_L$ and the axial direction $X_L$ in the upper antivibration mount 40AL and a crossing angle $\theta_R$ between the straight line $C_R$ and the axial direction $X_R$ in the upper antivibration mount 40AR are different from each other. Accordingly, the pair of upper antivibration mounts 40A are bilaterally asymmetrical to each other.

Thus, in a case where the pair of upper antivibration mounts 40A are bilaterally asymmetrical to each other, the manner of receiving a force by the upper antivibration mount 40A differs from each other between the pair of upper antivibration mounts 40A. In this case, even if the axial direction X and the tangential direction T become parallel to each other in a planar view in one upper antivibration mount 40A according to forward and rearward movement of the center Q of rolling, the axial direction X and the tangential direction T in the other upper antivibration mount 40A always cross each other in a planar view. Accordingly, both upper antivibration mounts 40A do not equally elastically deform, and the other upper antivibration mount 40A is able to bear a load in the perpendicular direction Y in which the rigidity is high. Thus, when the elastic deformation amount of the elastic portion 42 in at least one upper antivibration mount 40A is reduced, even if a location of the center Q in the front-rear direction differs depending on the kind of the outboard motor 1, rolling of the outboard motor main body 10 is reduced.

Due to a so-called paddle rudder effect, in the outboard motor 1, a reaction force F is generated by rotation of the propeller 4. In a case where a propulsive force to propel the hull 2 forward is generated when the propeller 4 rotates clockwise as viewed from the rear side, a direction of application of the reaction force F is rightward. Of the pair of upper antivibration mounts 40A, the upper antivibration mount 40AL is a first upper antivibration mount 40A positioned upstream in the direction of application of the reaction force F. As a cause of rolling of the outboard motor main body 10, when an influence of the reaction force F is great, a proportion of the reaction force F to a force to be applied from the outboard motor main body 10 to the antivibration mounts 40 when rolling occurs is high. In this case, the application location V to which a force from the outboard motor main body 10 is applied in the upper antivibration mount 40AL when rolling occurs, is preferably disposed farther apart forward from the center Q of rolling than the application location V in the other (second) upper antivibration mount 40AR. In FIG. 4A, the straight line $C_L$ connecting the center Q and the application location V in the upper antivibration mount AL is longer in the front-rear direction than the straight line $C_R$ in the upper antivibration mount 40AR. Also in this case, the pair of upper antivibration mounts 40A are bilaterally asymmetrical to each other.

The upper antivibration mount 40AL receives a force from the outboard motor main body 10 at a location distant from the center Q of rolling. Accordingly, the upper antivibration mount 40AL is less influenced by the reaction force F according to "the principle of leverage" using the center Q of rolling as a fulcrum. Therefore, the upper antivibration mount 40AL attenuates vibration of the outboard motor main body 10 by absorbing the force from the outboard motor main body 10 by a small elastic deformation amount. Accordingly, the elastic deformation amount in the upper antivibration mount 40AL is reduced, therefore, rolling of the outboard motor main body 10 is reduced. Thus, in a case where deformation in the axial direction X and/or the perpendicular direction Y is not considered, in the upper antivibration mount 40AL, the shaft 41 which serves as a core may be omitted and the elastic portion 42 may be solid.

Other Preferred Embodiments

Although preferred embodiments of the present invention have been described above, the present invention is not restricted to the contents of the preferred embodiments and various modifications of various preferred embodiments of the present invention are possible within the scope of the present invention.

To make the pair of upper antivibration mounts 40A bilaterally asymmetrical to each other, hereinafter, a first modification to a third modification of preferred embodiments of the present invention are described.

Figure 5:
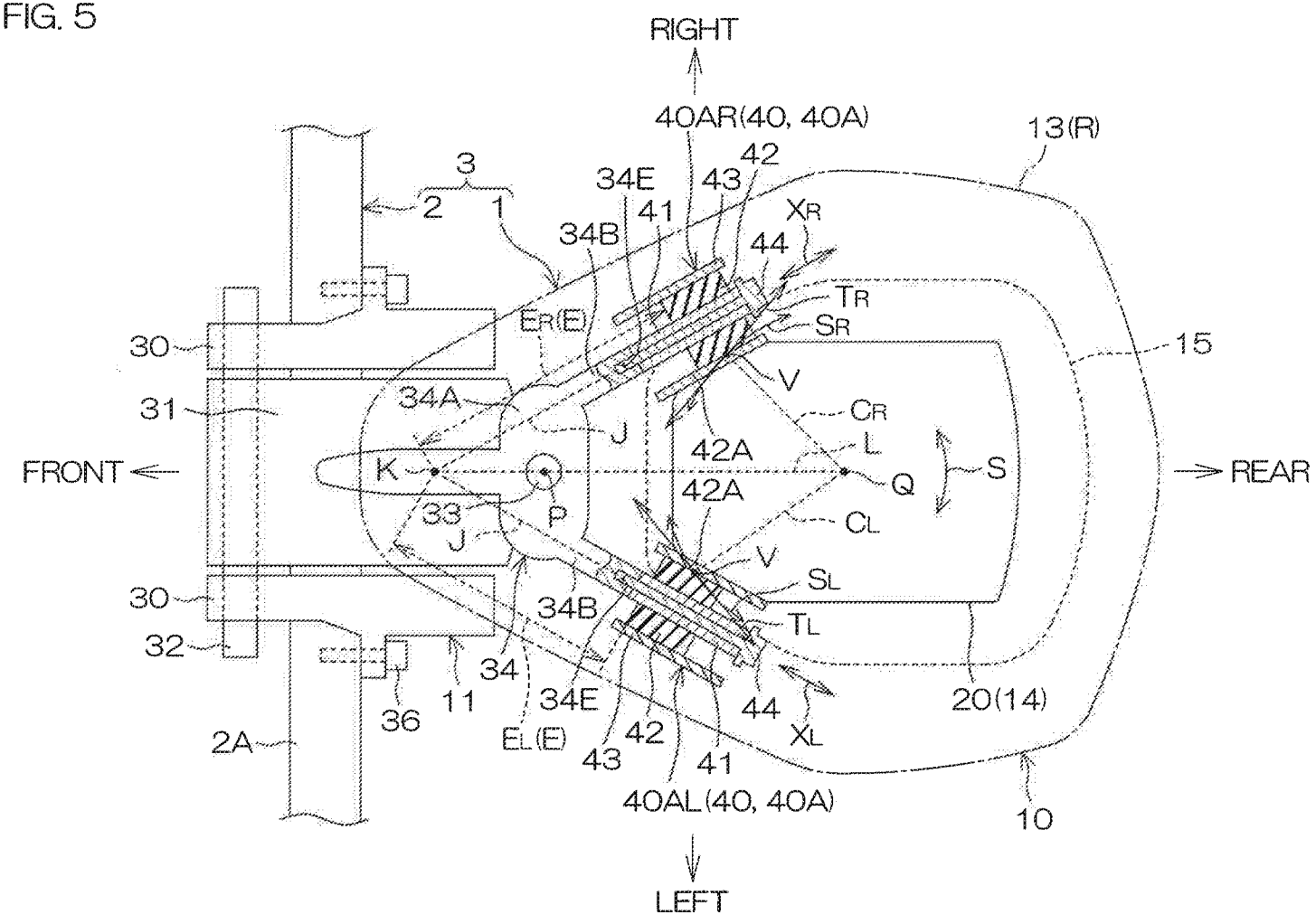
FIG. 5 is a schematic plan view of a portion of the hull and an outboard motor according to a first modification of a preferred embodiment of the present invention.

FIG. 5 is a schematic plan view of a portion of the hull 2 and an outboard motor 1 according to the first modification. In the first modification, in the pair of upper antivibration mounts 40A, the shafts 41, the outer cylinder portions 43, and the fasteners 44 may be bilaterally symmetrical by respectively having the same shape, the same dimensions, and the same layout. However, at least the elastic portions 42 are arranged differently so as to become bilaterally asymmetrical to each other between the pair of upper antivibration mounts 40A.

Specifically, although the elastic portions 42 have the same shape and the same dimensions, the direct distance E from the above-described intersection K to the elastic portion 42 differs from each other between the pair of upper antivibration mounts 40A. As an example, in the upper antivibration mount 40AL, the direct distance E (referred to as a direct distance $E_L$) is relatively short, so that the elastic portion 42 surrounds a front end of the shaft 41 close to the intersection K. On the other hand, in the upper antivibration mount 40AR, the direct distance E (referred to as a direct distance $E_R$) is relatively long, so that the elastic portion 42 surrounds a rear end of the shaft 41 distant from the intersection K. The direct distance $E_R$ is longer than the direct distance $E_L$. Therefore, the location of the elastic portion 42 in the front-rear direction differs from each other between the pair of upper antivibration mounts 40A. Accordingly, in at least one antivibration mount 40, the axial direction X of the shaft 41 and the tangential direction T at the application location V cross each other in a planar view. Therefore, by reducing an elastic deformation amount of the elastic portion 42 of at least one of the antivibration mounts 40, rolling of the outboard motor main body 10 is reduced.

In this case, the pair of upper antivibration mounts 40A include common components, and the location of the elastic portion 42 in the front-rear direction is made to differ from each other between the pair of upper antivibration mounts 40A.

Figure 6:
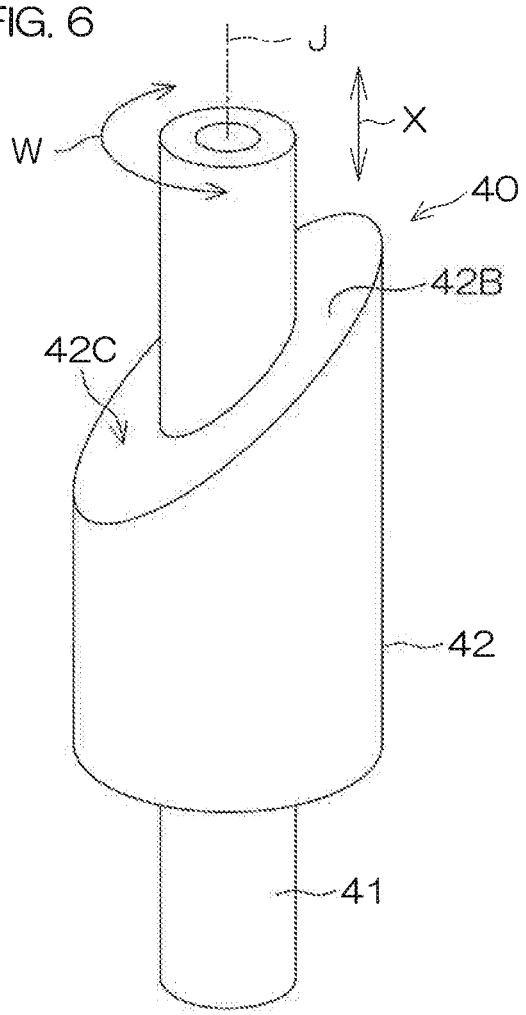
FIG. 6 is a schematic perspective view of an antivibration mount in an outboard motor according to a second modification of a preferred embodiment of the present invention.

FIG. 6 is a schematic perspective view of an antivibration mount 40 in an outboard motor 1 according to the second modification. In the second modification, only one end surface 42B of both end surfaces of the elastic portion 42 in the axial direction X is inclined with respect to the axial direction X. Accordingly, on the end surface 42B of the elastic portion 42, a cut-away portion 42C is provided by, for example, cutting away a portion in the circumferential direction W around the shaft 41. In FIG. 6, the cut-away portion 42C is provided by diagonally cutting away almost the entire region of the end surface 42B except for a portion on the circumference, however, the shape of the cut-away portion 42C may be arbitrarily changed.

Figure 7:
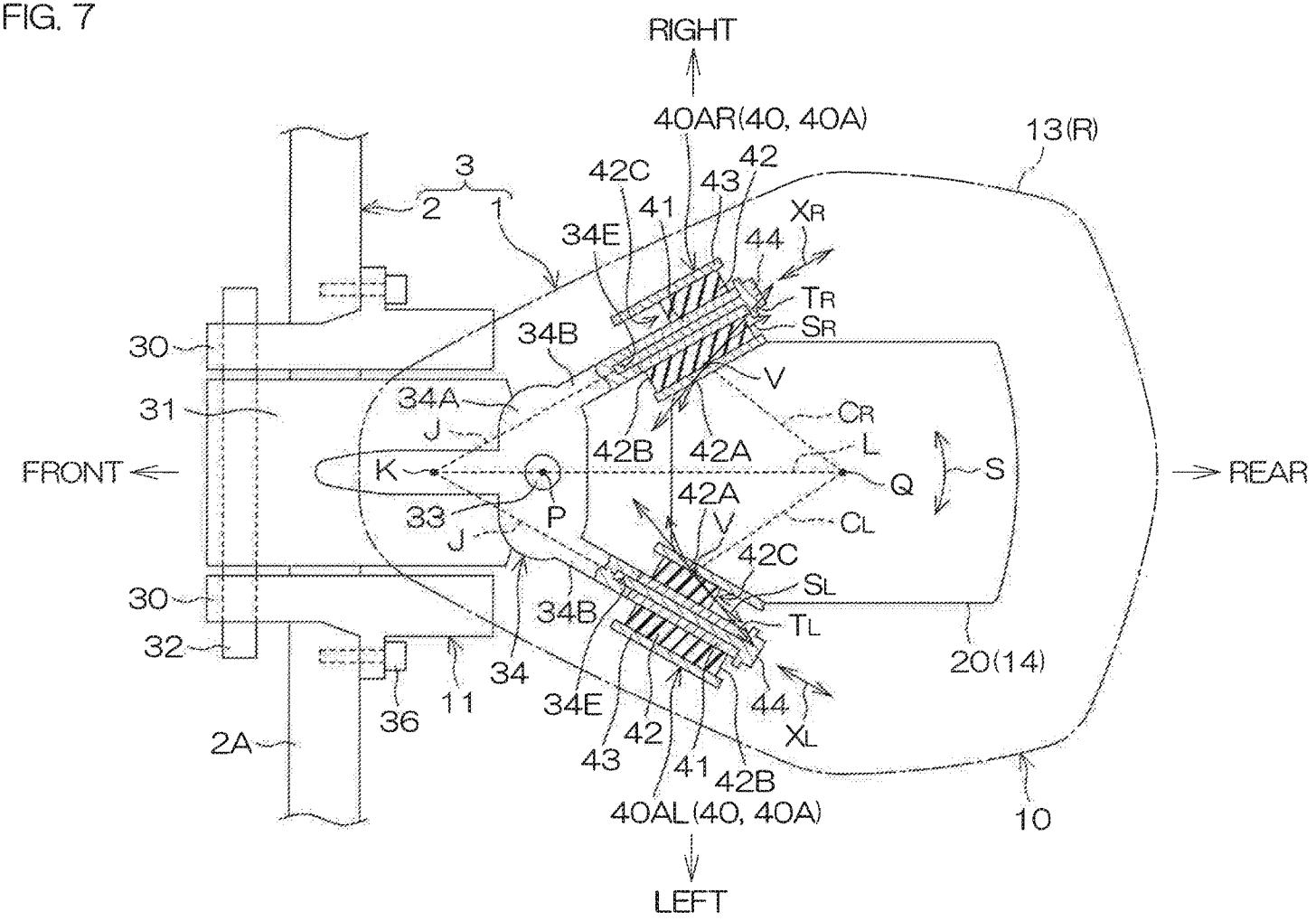
FIG. 7 is a schematic plan view of a portion of the hull and the outboard motor according to the second modification.

FIG. 7 is a schematic plan view of a portion of the hull 2 and the outboard motor 1 according to the second modification. The location of the cut-away portion 42C in the front-rear direction differs from each other between the pair of upper antivibration mounts 40A. In FIG. 7, the cut-away portion 42C of the upper antivibration mount 40AL is displaced rearward relative to the cut-away portion 42C of the upper antivibration mount 40AR. Accordingly, the pair of upper antivibration mounts 40A are bilaterally asymmetrical to each other, therefore, rolling of the outboard motor main body 10 is reduced. In the second modification, according to the difference in the location of the cut-away portion 42C, the application location V in the elastic portion 42 preferably differ from each other between the pair of upper antivibration mounts 40A in the front-rear direction. Accordingly, in at least one of the antivibration mounts 40, the axial direction X of the shaft 41 and the tangential direction T at the application location V cross each other in a planar view.

Figure 8:
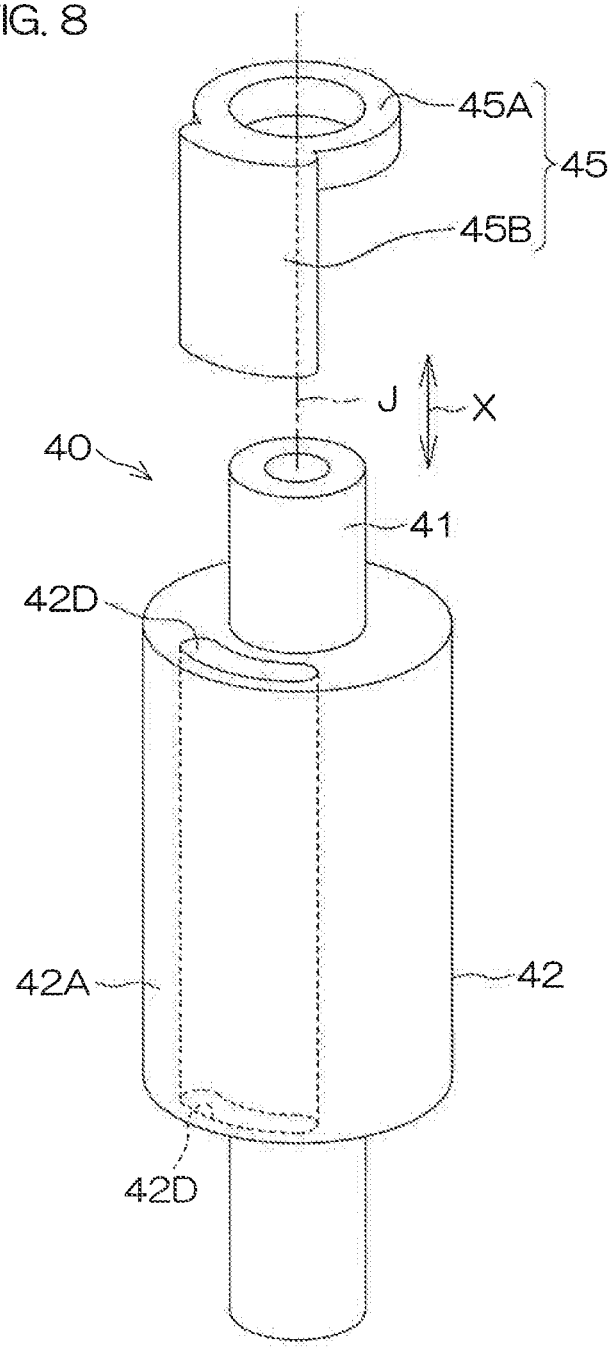
FIG. 8 is a schematic exploded perspective view of an antivibration mount in an outboard motor according to a third modification of a preferred embodiment of the present invention.

FIG. 8 is a schematic exploded perspective view of an antivibration mount 40 in an outboard motor 1 according to the third modification. In the third modification, in the elastic portion 42, for example, in a portion between the region 42A and the shaft 41, an insertion hole 42D extending in the axial direction X and penetrating through the elastic portion 42 is provided. Each of the pair of upper antivibration mounts 40A further includes an insertion member 45. The insertion member 45 is preferably made of a material (for example, resin or hard rubber such as urethane) harder than the elastic portion 42, and integrally includes a base 45A and an insertion portion 45B. The base 45A preferably has an annular or substantially annular shape having a central axis extending along the axial direction X. The insertion portion 45B projects from one point on the circumference of the base 45A and extends in the axial direction X. In terms of a dimension in the axial direction X, the insertion portion 45B is smaller than the insertion hole 42D. The insertion member 45 is fitted to the shaft 41 and the elastic portion 42 from the axial direction X. In the insertion member 45 after fitting, the base 45A surrounds the shaft 41, and the insertion portion 45B is inserted in the insertion hole 42D.

Figure 9:
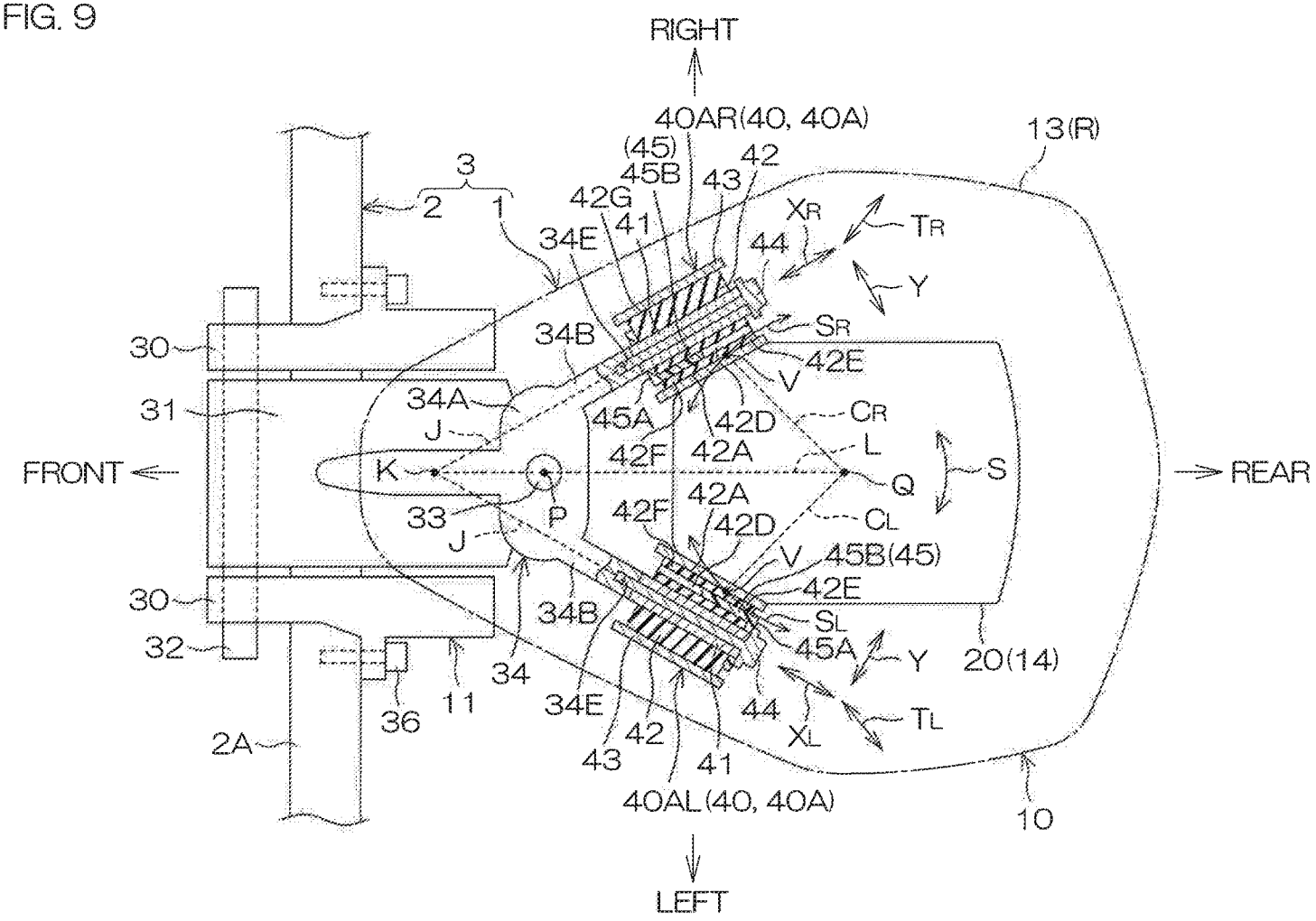
FIG. 9 is a schematic plan view of a portion of the hull and the outboard motor according to the third modification.

FIG. 9 is a schematic plan view of a portion of the hull 2 and the outboard motor 1 according to the third modification. The position of the insertion portion 45B in the insertion hole 42D differs from each other between the pair of upper antivibration mounts 40A. In the case of FIG. 9, in the upper antivibration mount 40AL, the insertion member 45 is fitted to the shaft 41 and the elastic portion 42 from the rear side, and in the upper antivibration mount 40AR, the insertion member 45 is fitted to the shaft 41 and the elastic portion 42 from the front side. Therefore, the insertion portion 45B of the upper antivibration mount 40AR is displaced forward relative to the insertion portion 45B of the upper antivibration mount 40AL.

In the elastic portion 42, the portion at the same position as the insertion portion 45B in the axial direction X is reinforced by the insertion portion 45B and accordingly hardly deforms in the perpendicular direction Y. Therefore, in the elastic portion 42 of the upper antivibration mount 40AL, rigidity in the perpendicular direction Y of a rear portion 42E at the same position as the insertion portion 45B in the axial direction X is higher than a rigidity in the perpendicular direction Y of a front portion 42F displaced from the insertion portion 45B. In the elastic portion 42 of the upper antivibration mount 40AR, a rigidity in the perpendicular direction Y of the front portion 42F at the same position as the insertion portion 45B in the axial direction X is higher than a rigidity in the perpendicular direction Y of the rear portion 42E displaced from the insertion portion 45B. In each of the pair of upper antivibration mounts 40A, the application location V is set at the rear portion 42E. Therefore, a rigidity in the perpendicular direction Y of a portion of the elastic portion 42 to which a force from the outboard motor main body 10 is applied when rolling occurs differs from each other between the pair of upper antivibration mounts 40A. Accordingly, the pair of upper antivibration mounts 40A are bilaterally asymmetrical to each other, therefore, rolling of the outboard motor main body 10 is reduced.

In the third modification, in each of the pair of upper antivibration mounts 40A, the application location V may be set to the same location as the insertion portion 45B in the axial direction X. In this case, a rigidity of a portion of the elastic portion 42 to which a force from the outboard motor main body 10 is applied is the same between the pair of upper antivibration mounts 40A, however, the application location V in the front-rear direction differs from each other between the pair of upper antivibration mounts 40A. In this case, as described above, in at least one antivibration mount 40, the axial direction X of the shaft 41 and the tangential direction T at the application location V cross each other in a planar view.

For example, when the pair of lower antivibration mounts 40B are similar to the pair of upper antivibration mounts 40A, an elastic deformation amount in at least one antivibration mount 40 of each pair of antivibration mounts 40 is reduced, therefore, rolling of the outboard motor main body 10 is further reduced.

On the outer circumferential surface of the elastic portion 42 of each antivibration mount 40, an application location V may also be set in a region (for example, an outer region 42G located opposite to the region 42A in the left-right direction) other than the above-described region 42A. In this case, the above-described structure that makes the pair of antivibration mounts 40 bilaterally asymmetrical to each other may also be applied.

In the elastic portion 42, a portion that does not elastically deform, that is, a portion that does not contribute to attenuation of vibration of the outboard motor main body 10 may be omitted. The elastic portion 42 in this case may not be cylindrical, and is required to be provided in at least a portion of the outer circumferential surface of the shaft 41 facing the outboard motor main body 10.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an outboard motor main body including an engine and a propeller driven by the engine;

a bracket to attach the outboard motor main body to a hull; and a pair of antivibration mounts that are joined to the bracket, sandwich and elastically support a portion of the outboard motor main body from a left and a right of the outboard motor main body, are arranged side by side in a left-right direction of the outboard motor so that a center of rolling of the outboard motor main body is located between the pair of antivibration mounts in the left-right direction, and are bilaterally asymmetrical to each other.

2. The outboard motor according to claim 1, wherein each of the pair of antivibration mounts includes a shaft extending rearward from the bracket, and an elastic portion having a cylindrical or substantially cylindrical shape surrounding the shaft and joined to the outboard motor main body.

3. The outboard motor according to claim 2, wherein, in at least one of the pair of antivibration mounts, an axial direction of the shaft and a tangential direction with respect to a circumferential direction around the center of rolling at a location in the elastic portion to which a force from the outboard motor main body is applied when the rolling occurs cross each other in a planar view.

4. The outboard motor according to claim 3, wherein the location in the elastic portion to which the force from the outboard motor main body is applied when rolling occurs differs between the pair of antivibration mounts in a front-rear direction of the outboard motor.

5. The outboard motor according to claim 3, wherein a location of the elastic portion in a front-rear direction of the outboard motor differs between the pair of antivibration mounts.

6. The outboard motor according to claim 2, wherein in the elastic portion, a cut-away portion is provided in a circumferential direction around the shaft; and a location of the cut-away portion in a front-rear direction of the outboard motor differs between the pair of antivibration mounts.

7. The outboard motor according to claim 2, wherein a rigidity of a portion of the elastic portion to which a force from the outboard motor main body is applied when rolling occurs differs between the pair of antivibration mounts.

8. The outboard motor according to claim 2, wherein the elastic portion includes an insertion hole extending in the axial direction of the shaft;

each of the pair of antivibration mounts includes an insertion member to be inserted into the insertion hole; and a location of the insertion member in the insertion hole differs between the pair of antivibration mounts.

9. The outboard motor according to claim 1, wherein the pair of antivibration mounts includes a first antivibration mount located upstream in a direction in which a reaction force generated by rotation of the propeller is applied, a location to which a force from the outboard motor main body is applied when rolling occurs is disposed farther apart from the center of rolling than a location in a second antivibration mount to which a force from the outboard motor main body is applied when rolling occurs.

10. The outboard motor according to claim 1, further comprising a plurality of pairs of antivibration mounts spaced apart in an up-down direction of the outboard motor.

11. The outboard motor according to claim 1, wherein at least a portion of the pair of antivibration mounts is disposed directly below the engine.

* * * * *